United States Patent [19]

Spencer et al.

[11] Patent Number: 5,008,071

[45] Date of Patent: Apr. 16, 1991

[54] METHOD FOR PRODUCING IMPROVED TUNGSTEN NICKEL IRON ALLOYS

[75] Inventors: James R. Spencer, Sayre; James A. Mullendore, Towanda, both of Pa.

[73] Assignee: GTE Products Corporation, Stamford, Conn.

[21] Appl. No.: 275,820

[22] Filed: Nov. 25, 1988

Related U.S. Application Data

[62] Division of Ser. No. 140,504, Jan. 4, 1988, abandoned.

[51] Int. Cl.[5] ..... B22F 3/24

[52] U.S. Cl. ..... 419/28; 419/32; 419/38; 419/47; 419/53; 419/54; 419/57; 419/58

[58] Field of Search ..... 75/248, 225; 419/28, 419/38, 53, 54, 47, 32

[56] References Cited

U.S. PATENT DOCUMENTS

| | | | |
|---|---|---|---|
| Re. 24,674 | 7/1959 | Ang | 75/248 |
| 2,206,537 | 7/1940 | Price | 420/430 |
| 2,793,951 | 5/1957 | Green et al. | 75/214 |
| 3,241,955 | 3/1966 | Neeley | 420/430 |
| 3,656,731 | 4/1972 | Larson | 75/248 |
| 3,669,656 | 6/1972 | Murphy et al. | 420/430 |
| 3,888,636 | 6/1975 | Sczerzenie | 75/248 |
| 3,929,424 | 12/1975 | Kruck et al. | 75/248 |
| 3,946,673 | 3/1976 | Hayes | 420/430 |
| 3,979,234 | 9/1976 | Northcutt, Jr. et al. | 148/126 |
| 3,988,118 | 10/1976 | Grierson et al. | 420/430 |
| 4,012,230 | 3/1977 | Dickinson et al. | 419/25 |
| 4,090,875 | 5/1978 | Ludwig | 75/248 |
| 4,332,617 | 6/1982 | Hovis, Jr. et al. | 75/214 |
| 4,458,599 | 7/1984 | Mullendore et al. | 75/748 |
| 4,498,395 | 2/1985 | Kock et al. | 419/35 |
| 4,605,599 | 8/1986 | Penrice et al. | 428/665 |
| 4,643,099 | 2/1987 | Luther et al. | 102/517 |
| 4,698,096 | 10/1987 | Schmidberger et al. | 420/430 |
| 4,724,769 | 2/1988 | Luther et al. | 102/518 |
| 4,744,944 | 5/1988 | Spencer et al. | 75/248 |
| 4,762,559 | 8/1988 | Penrice et al. | 75/248 |
| 4,765,952 | 8/1988 | Kemp, Jr. | 419/47 |
| 4,847,045 | 7/1989 | Kemp, Jr. et al. | 419/36 |

FOREIGN PATENT DOCUMENTS

| | | | |
|---|---|---|---|
| 0204909 | 12/1986 | European Pat. Off. . | |
| 1948669 | 4/1971 | Fed. Rep. of Germany | 75/248 |
| 1050703 | 4/1986 | France . | |

OTHER PUBLICATIONS

Holtz et al., "Development and Evaluation of High--Temperature Tungsten Alloys", (Apr. 1959), Wright Air Development Center Federal Report 59-19, *Armour Research Foundation of Illinois Institute of Technology.*

Chemical Abstract 68: 15356, vol. 68 (1968), "Properties of Heavy Metal Composites".

*Primary Examiner*—Stephen J. Lechert, Jr.
*Assistant Examiner*—Nina Bhat
*Attorney, Agent, or Firm*—Donald R. Castle

[57] ABSTRACT

A consolidated tungsten alloy body consisting essentially of from about 70% to about 98% by weight of tungsten, balance nickel and iron in essentially an 8:2 weight ratio. A process for producing the consolidated bodies where the tungsten content is greater than about 88% by weight comprises forming a relative uniform blend of the described metal powders, compacting the powders to form a green body then liquid phase sintering the green body to full density. For alloys containing less than about 90% tungsten solid state sintering can be used.

1 Claim, No Drawings

METHOD FOR PRODUCING IMPROVED TUNGSTEN NICKEL IRON ALLOYS

This application is a division of application Ser. No. 140,504, filed Jan. 4, 1988, now abandoned.

SUMMARY OF THE INVENTION

In accordance with one aspect of this invention there is provided a consolidated tungsten base alloy body consisting, essentially of from about 70% to about 98% by weight of tungsten, balance nickel and iron in essentially an 8:2 weight ratio.

In accordance with another aspect of this invention, there is provided a process for producing consolidated bodies having improved mechanical properties (a) forming a relatively uniform blend of elemental metal powders, wherein the blend consists essentially of from about 88% to about 98% by weight of tungsten, balance nickel and iron in essentially an 8:2 weight ratio, (b) pressing the powder to form a green body, (c) solid state presintering the green body in a reducing atmosphere for a time sufficient to achieve a partially dense body containing sufficient strength to enable handling and (d) sintering the partially dense body to full density in a reducing atmosphere at a temperature sufficiently elevated to achieve liquid phase sintering.

In accordance with another aspect of this invention a tungsten alloy containing from about 70% to about 90% by weight of tungsten is prepared by following essentially the same procedure as with the alloys having higher amounts of tungsten except that only solid state sintering is used, thus, sintering temperatures of less than about 1450° C. are used.

DETAILED DESCRIPTION OF THE PREFERRED EMBODIMENT

For a better understanding of the present invention, together with other and further objects, advantages, and capabilities thereof, reference is made to the following disclosure and appended claims in connection with the above described description of some of the aspects of the invention.

In the practice of the process of this invention a relatively uniform blend of the elemental metal powders is preferably prepared. While the elemental metal powders are preferred as the initial starting material, metallic salts having a fugitive nonmetallic components can be used as long as the proper amount of metallic elements are present in the blend. After the relative uniform blend is made by using conventional blending equipment such as a V blender, the material is heated to remove the volatile component if any are present. Time and temperatures will depend upon the materials that are used and will be known to those skilled in the art of powder metallurgy.

After the uniform blend of elemental metal powders is formed the powders are pressed into a green body having sufficient strength to prevent breakage during the normal handling required in moving the bodies from the presses used to form the green bodies to other locations such as the sintering furnaces. A typical consolidation technique for producing green bodies is an isostatic press using pressures of from about 30 psi to about 50 psi.

In preparing alloys having a tungsten content of about 88% by weight or above the green body is solid state sintered at a temperature below the melting point of any of the elements for a period of time sufficient to remove any binders used to aid in the pressing to form a green body and to achieve a density sufficient to enable handling which is generally greater than about 80% of theoretical. Since nickel is the lowest melting element utilized in the practice of this invention, the initial temperature will be below about 1425° C. and preferably about 1400° C. The time required for sintering at about 400° C. is about 4 hours. Longer times are required for lower temperatures while shorter times are required at temperatures approaching the melting point of nickel. After the solid state sintering step the material is then sintered to full density by liquid phase sintering above the melting point of both iron and nickel to achieve full density and the desired microstructure, that is, rounded tungsten grains in a continuous second phase containing the iron and nickel. The actual sintering temperature will vary dePending upon the tungsten content, for example, for 93% tungsten about 1540–1545° C. for about 45 minutes is sufficient to achieve full density which is about 10 to about 15° C. higher than required for a 7:3 nickel to iron ratio material. While the afore-mentioned times and temperatures can be varied one skilled in the art of powder metallurgy will recognize that appreciablY higher temperatures merely add to the cost of the process while lower temperature do not achieve the desired degree of liquid phase sintering because the melting point of iron may not be reached.

Alloys containing from about 70% to about 90% by weight of tungsten can be prepared by following essentially the same Procedure as with the alloys having from about 88% or above of tungsten except that solid state sintering only is used, thus, sintering temperatures of less than about 1450° C. are used. Sintering is carried out in a reducing atmosphere which includes hydrogen, hydrogen-nitrogen mixtures and dissassociated ammonia.

To aid in the understanding of this invention the following detailed examples are presented. All parts percentages and proportions are by weight unless otherwise indicated.

EXAMPLE

Alloys are prepared by blending elememtal metal powders of the metals for about 90 minutes in a V-blender. Bars are made from the powder blends by isostatically pressing the blends at about 35 ksi. The bars are presintered in wet hydrogen for about 4 hours at about 1400° C. which produces a 90% dense material. The partially densified bars are sintered in a wet hydrogen atmosphere at temperatures ranging from 1510° C. to about 1540° C. for the 90% tungsten and the 93% tungsten alloys respectively.

An alloy containing 90% tungsten with an Ni:Fe weight ratio of 8:2 has an impact strength of over 50 ft-lbs as compared to 28 ft-lbs for a similar alloy having a 7:3 Ni:Fe weight ratio. The tensile elongation is increased from an average of about 35% to an average of 41%. For a 93% tungsten alloy the impact strength is increased from 18 ft-lbs to 32 ft-lbs and the tensile elongation improved from an average of 33% to an average of 38%.

EXAMPLE 2

Alloys each containing about 70% tungsten are prepared by solid state sintering at from about 1400° C. to about 1420° C. for about 4 hours in wet hydrogen. Rolled sheets of tunsten prepared as above are compared. The material having the 7:3 Ni:Fe ratio has a tensile elongation of about 15% while the material having the 8:2 Ni:Fe ratio has a tensile elongation of about 25%.

While there has been shown and described what are considered the preferred embodiments of the invention, it will be obvious to those skilled in the art that various changes and modifications may be made therein without departing from the scope of the invention as defined by the appended claims.

What is claimed is:

1. A process for producing rolled sheets of tungsten heavy metal alloy having improved tensile elongation comprising:

(a) forming a relatively uniform blend of elemental metal powders, wherein the blend consists essentially of 93% by weight of tungsten, balance nickel and iron in essentially an 8:2 weight ratio of nickel to iron, (b) pressing the powder to form a green body in the shape of a bar, (c) sintering the green body in a reducing atmosphere at a temperature below about 1425° C. for a time sufficient to achieve a partially dense body containing sufficient strength to enable handling, and (d) sintering the partially dense body to full density and a microstructure consisting essentially of rounded tungsten grains in a continuous second phase containing iron and nickel by liquid phase sintering in a reducing atmosphere at temperature sufficiently elevated and above the melting point of both iron and nickel to achieve liquid phase sintering, said temperature being in the range of from about 1540–1545° C. said sintering of said partially dense body forming a resulting sintered body, and (e) forming rolled sheets from said resulting sintered body wherein said rolled sheets has a tensile elongation of about 25 percent.

* * * * *